United States Patent [19]

Jenkins et al.

[11] 3,994,433

[45] Nov. 30, 1976

[54] ONE-PIECE, FOLDING, SELF LOCKING CORNER PAD

[75] Inventors: James Robert Jenkins, Minneapolis; James Arthur Thole, St. Michael, both of Minn.

[73] Assignee: Federal Package Corporation, Minneapolis, Minn.

[22] Filed: May 14, 1975

[21] Appl. No.: 577,193

[52] U.S. Cl. ..... 229/14 C; 206/523; 229/DIG. 1

[51] Int. Cl.[2] ..... B65D 81/04; B65D 85/30

[58] Field of Search ..... 229/14 C, DIG. 1; 206/523

[56] References Cited

UNITED STATES PATENTS

| | | | |
|---|---|---|---|
| 3,334,798 | 8/1967 | Pezely, Jr. et al. | 229/14 C |
| 3,410,474 | 11/1968 | Keil | 229/14 C |
| 3,482,759 | 12/1969 | Ortiz | 229/14 C |
| 3,565,243 | 2/1971 | Freeman | 229/14 C |
| 3,580,469 | 5/1971 | Reese | 229/14 C |
| 3,695,421 | 10/1972 | Wood | 206/523 |
| 3,843,038 | 10/1974 | Sax | 229/DIG. 1 X |
| 3,854,650 | 12/1974 | Hanaue | 229/14 C |

*Primary Examiner*—Davis T. Moorhead
*Attorney, Agent, or Firm*—Francis J. Bouda

[57] ABSTRACT

A corner pad for use in packaging fragile articles, formed from a single, flat piece of thick yieldable, shock-absorbing synthetic cushioning material which can be shipped and stored in flat form and which has an integral tab-and-slot locking arrangement to provide means for holding the corner pad in a three-sided configuration without using any adhesives, tapes, clips or other fasteners.

3 Claims, 12 Drawing Figures

Fig. 1
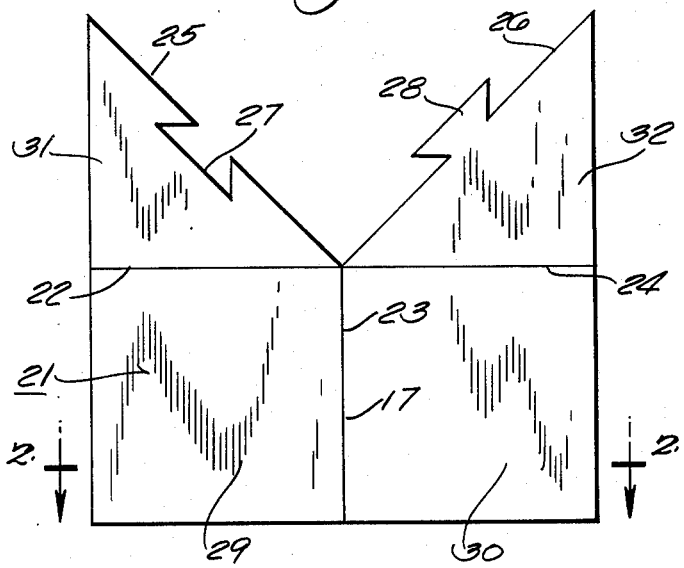
Fig. 3
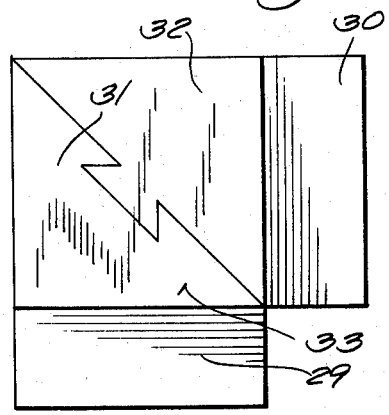
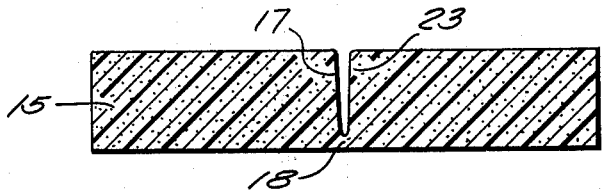
Fig. 2.
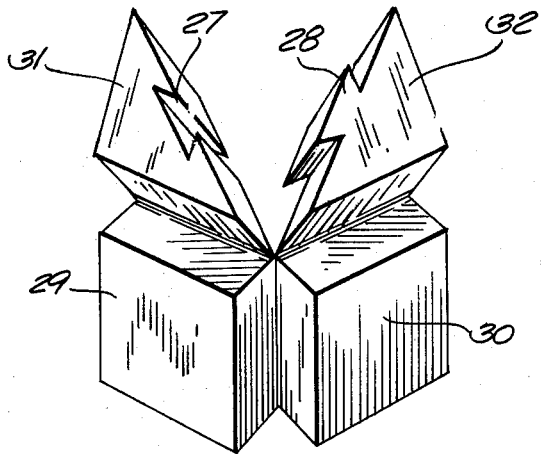
Fig. 4
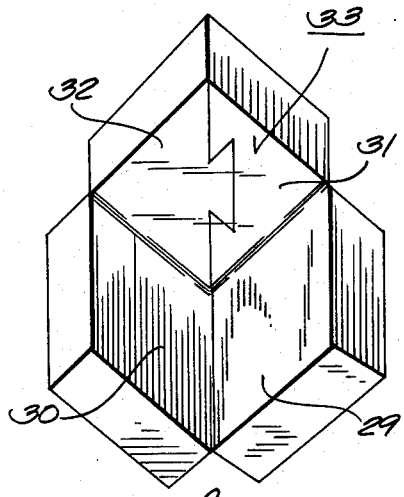
Fig. 5

ONE-PIECE, FOLDING, SELF LOCKING CORNER PAD

BACKGROUND OF THE INVENTION

Resilient packaging material and particularly thick separators or spacers made from resilient, yieldable shock-absorbing packaging material are not new.

Nor is it new to construct and arrange a corner pad from relatively thick resilient material in such manner that the corner pad may be stored and shipped flat, subsequently to be "popped" by the customer into the three sided configuration desireable for corner pad protection. (See particularly U.S. Pat. No. 3,580,469, which is owned by Inventor's Assignee's Parent Corporation.) However, the corner pad of the present invention distinguishes over prior structures because it provides an interlocking self-contained tab-and-slot which permits the corner pad to be "set-up" without the need for any adhesives, tapes, pins, clips or the like.

SUMMARY OF THE INVENTION

It is an object of the present invention to provide a corner pad used in packaging of fragile items such as are generally shipped in rectangular cartons with the fragile materials spaced from the side walls and inner surface of the carton by resilient pads of yieldable material which provide contact-separating spacers as well as shock-absorbing supports.

The corner pad of the present invention is designed to be produced in flat form at the factory and may be shipped in such form to the customer for self-erection and use on the site or it may be assembled at the factory and shipped ready for use to the customer. However, the latter arrangement is expensive and costly because the three dimensional configuration of the corner pad requires the shipment of excessive air within the container.

Thus, by providing a structure which is unitary, slit-scored on the bending lines for easy manipulation and which includes a self-contained interlocking tab, there is provided an easily assembled, simple to use, and more importantly, a reuseable structure which can be demounted flattened, and stored for re-use or shipped back to the original supplier.

DETAILED DESCRIPTION

For the purpose of illustrating the invention, there are shown in the accompanying drawings forms thereof, which are at present preferred, although it is to be understood that the various instrumentalities of which the invention consists can be variously arranged and organized, and that the invention is not limited to the precise arrangement and organizations of the instrumentalities as herein shown and described.

In the drawings, wherein like reference characters indicate like parts,

FIG. 1 Represents a top plan view of one of the corner pads of the present invention.

FIG. 2 Represents an end view of the pad shown in FIG. 1.

FIG. 3 Represents a top plan view of one of the corner pads after folding and interlocking the tab-and-slot.

FIG. 4 Represents a perspective view of one of the corner pads of the present invention during the folding process which brings the corner pad from the flat, planar position shown in FIG. 1 to the set-up position shown in FIG. 3.

FIG. 5 Represents a perspective view of the corner pad of the present invention shown, from the underside, in set-up position similar to that position shown in FIG. 3.

Figure 6:
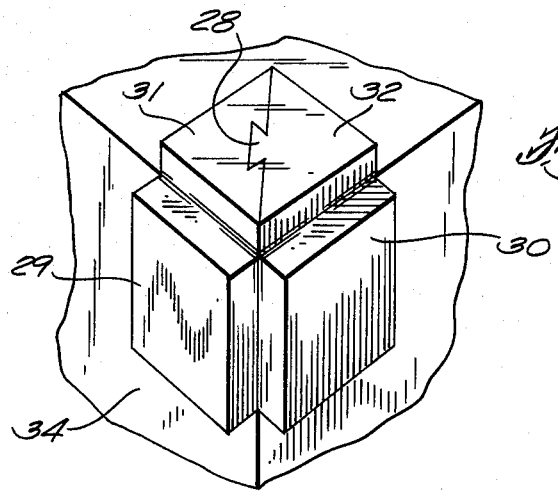
FIG. 6 Represents a perspective view of one of the corner pads of the present invention in position on the corner of an article to be protected by such corner pads.

In the present invention the base material 15 is relatively thick (approximately 1½ to 2 inches thick) foamed polyethylene of the type produced by Dow Chemical Corporation under the Trademark "Ethafoam". This base material is cut and slit-scored to provide a maximum utilization of the base material. In FIG. 2 the line 17 illustrates a slit-scoring where the slit passes substantially through the thickness of the sheet but leaves a small portion 18 which provides a self-hinge in the base material.

With reference to FIG. 1, it can be seen that each of the corner pads 21 is slit-scored along lines 22, 23 and 24 to provide an integral hinge 18 which permits the folding of the respective quadrants of the corner pad along such hinge lines 18, as is shown particularly in FIG. 4. The edges 25 and 26 are disposed at a 90° angle to each other and the edges 25 has a slot 27 therein while the edge 26 has a tab 28 therealong. The slot 27 and the tab 28 are disposed along their respective edges so that when the edges 25 and 26 are brought together, the tab 28 and slot 27 can be brought into interlocking relationship by sliding the tab into the slot, as is shown particularly in FIGS. 3 and 5.

Because of the strong, resilient characteristics of polyethylene, the flexible base material provides resiliency which permits the interengagement of tab and slot without breaking or damaging thereof.

As is shown in FIG. 1, the corner pad 21 with its scores and slits provides a quadrant 29 and a quadrant 30 which, when folded, lie at right angles to each other, as shown in FIG. 5. The half quadrant 31 and half quadrant 32 when brought in interlocking relationship with the edges 25 and 26 in contact, provide the third quadrant 33, as shown in FIG. 5, which itself lies at right angles to each of the quadrants 29 and 30.

Thus, the corner pad, as assembled in FIG. 5, can be brought into overlapping relationship with adjacent sides and a corner of an article 34 to be protected, as is shown in FIG. 6. Four of such corner pads, appropriately disposed on the article will separate and space it from the outer protective container, and not only support but protect the fragile article against shock or damage.

Figure 8:
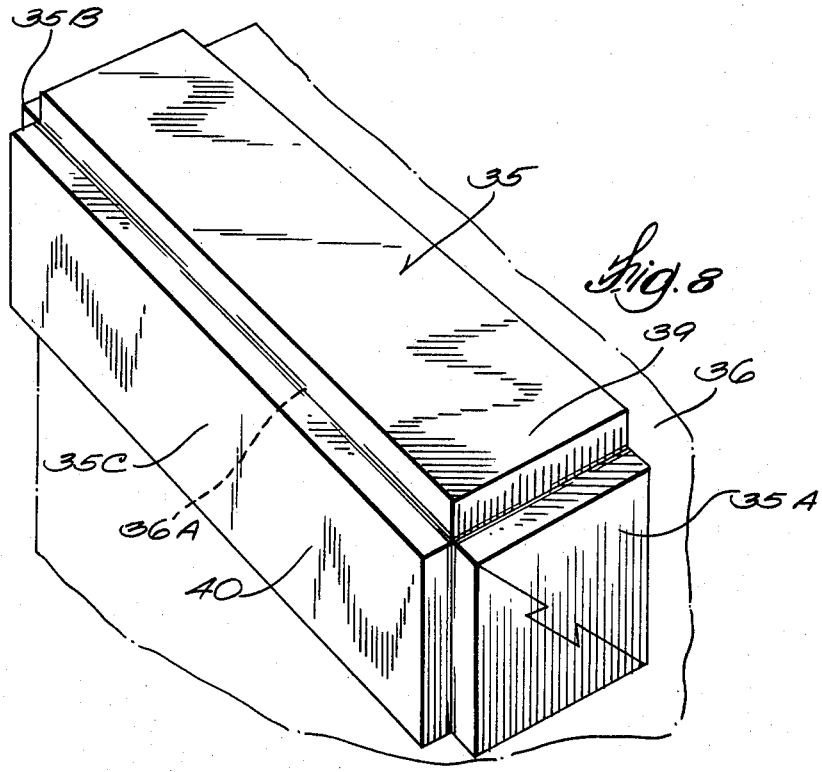
FIG. 8 Represents a perspective view of the corner pad shown in FIG. 7 illustrating how the double ended construction is used to protect two corners and an intervening edge of the article to be protected. This form is sometimes called a "corner post".

There is shown in FIG. 8 a second embodiment 35 of the present invention wherein the slits and scores are so disposed that two corner pad shapes 35-A and 35-B are disposed in relation to each other with an interconnecting portion 35-C of the base material so arranged that an elongated protector is provided which overwraps not only two corners of the article 36 but also the connecting edge 36-A there-along. This form is sometimes called a "corner post" in the protective packaging field.

Figure 7:
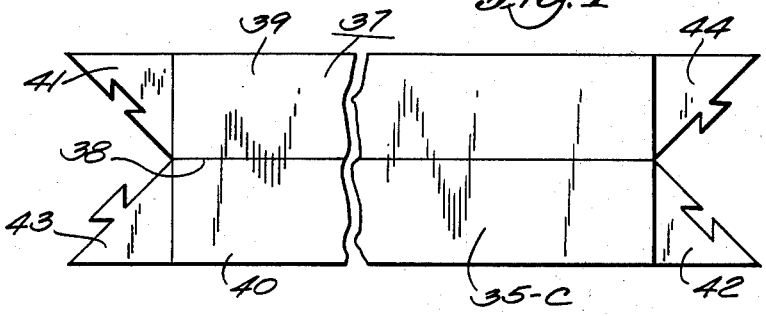
FIG. 7 Represents a top plan view of a modified double-ended form of the corner pad of the present invention constructed and arranged to cover one complete edge of an article to be protected.

The corner pad 35 as shown in FIG. 8 can be cut from the flat piece of base stock 37 as shown in FIG. 7 and the slit-score 38 and the edges 39 and 40 are elongated so as to be the same length as the edge 36-A of the article 36. The half-quadrants 41 and 42 are similar to the half quadrant 31 while the half quadrants 43 and 44 are similar to the half quadrant 32 previously discussed with respect to FIG. 2.

Thus, the interlocking of half quadrants 41 and 43 and half quadrants 42 and 44 provide the folded, unitary structure shown at 35 in FIG. 8.

It can be clearly seen from the foregoing description that there is no need for the use of adhesives to join the edges 25 and 26 together, nor is any tape of other fastening devise required as was required in the prior art.

Figure 9:
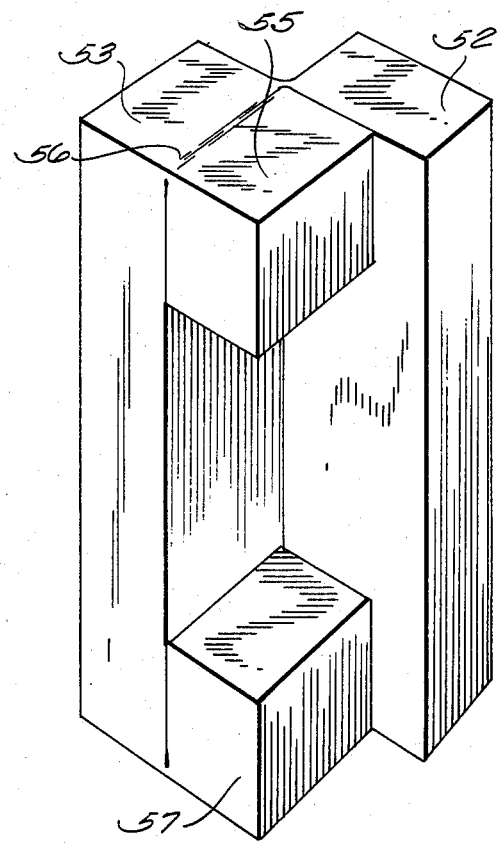
FIG. 9 Represents a perspective view of another embodiment of the corner pad of the present invention.
Figure 10:
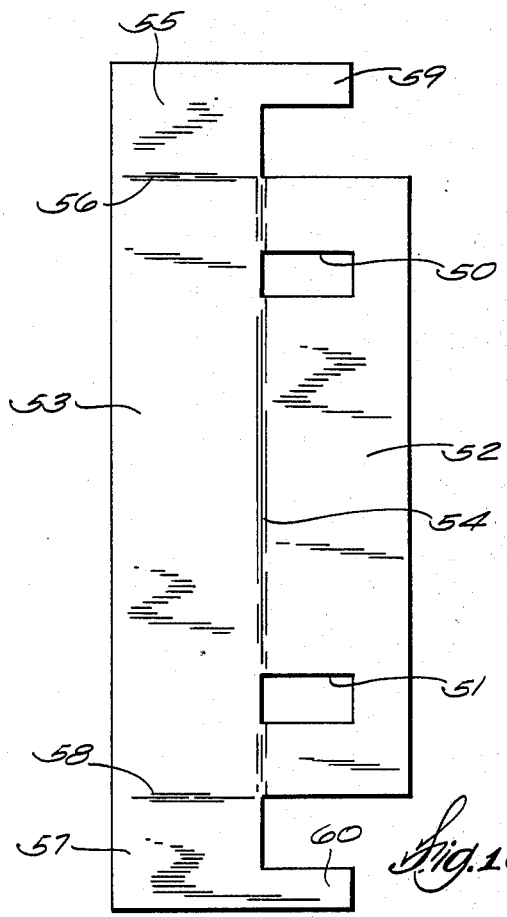
FIG. 10 Represents a plan view of the foam sheet, cut and slit-scored, prior to folding.

In the embodiment shown in FIG. 9 and in the prior-to-folding configuration shown in FIG. 10, the sheet is die-cut around its irregular perimeter and has two slots 50 and 51 punched through the body portion 52.

The body portion 52 is delineated from the body portion 53 by a slit-score line 54, and similarly, the end 55 is separated from the body portion 53 by a slit-score 56 and end 57 is separated from the body 53 by a slit-score 58.

It will be noted that end 55 has a tab 59 and end 57 has a tab 60.

Figure 11:
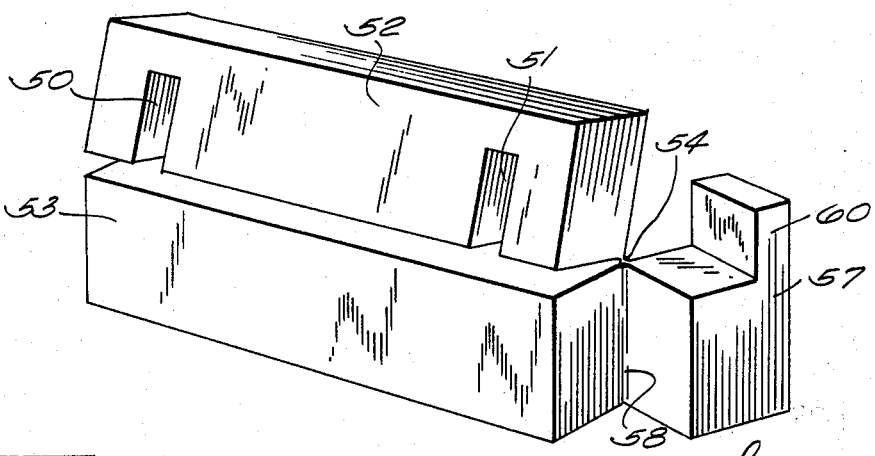
FIG. 11 Is a perspective view of the sheet of FIG. 10, partially folded, showing the procedure of bringing the end portion into interlocking relation between tab and slot.
Figure 12:
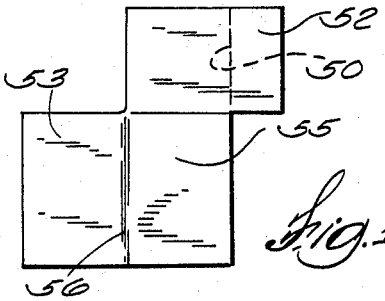
FIG. 12 Is an end view of the corner pad of FIG. 9.

As is shown more clearly in FIG. 11, the body portions 52 and 53 are folded along the hinge formed by the slit-score line 54 so that the end 57, folded along the slit-score line 58 can be brought beneath the body portion 52. The tab 60 is forced into the slit 51 to hold the end 57 against the body portion 53. With the tab 59 and 60 wedged in the slits 51 and 50, the body portions 52 and 53 and the ends 55 and 57 are maintained at right angles to each other to provide a generally rectangular corner post.

Whereas the corner post shown in FIG. 8 is quite satisfactory for enveloping and protecting the corners and edges of relatively large packages, it has been found that the corner post which is disclosed in FIG. 9 is more suitable for relatively small and more delicate structures.

The embodiment shown on FIGS. 1 through 8 inclusive, can be demounted, flattened, and reused, and similarly the corner post shown in FIGS. 9 through 12 inclusive, has the same advantage.

Thus, there is provided a less expensive, reusable, flat and re-flattenable corner pad which is more economical in use, which is more economical to manufacture and which is more economical to store then the corner pads of the prior art.

It is to be understood, however, that the present invention may be embodied in other specific form as without departing from the spirit or special attributes hereof, and it is therefore desired that the present embodiments be considered in all respects as illustrative and therefore not restrictive, reference being made to the appended claims rather than to the foregoing description to indicate the scope of the invention.

Having thus described the invention, what is claimed is new and desired to be protected by Letters Patent are the following:

1. A blank for use in protecting a corner of an article comprising: a first quarter-section and a second-quarter section joined together with an integral hinge by slit-scoring substantially all but not the entire line of separation between said quarter-sections, a first half-quarter-section interconnected to the first quarter-section along a similar slit-score hinge line, a second half quarter-section connected to the aforementioned second quarter-section by means of a similar slit-score hinge line, the aforesaid half quarter-sections having opposing faces disposed with respect to each other at a 90° angle, the opposing face in the first half quarter-section having a slot therein and the opposing face in the second half quarter-section having a tab disposed there-along, said tab and said slot being disposed along the respective opposing faces so that they will come into mating position when the said opposing faces are brought together.

2. A corner post for use in protecting a corner of an article comprising: a first body-section and a second body-section joined together with an integral slit-scored hinge, a first triangular section interconnected to one end of the first body-section and a second triangular section interconnected to the other end of the first body-section, a third triangular section interconnected to one end of the second body-section and a fourth triangular section interconnected to the other end of the second body-section, all such interconnections being made by slit-score lines, the first and third triangular section having opposing faces disposed at a 90° angle to each other, the second and fourth triangular section having opposing faces disposed at a 90° angle to each other, one of the faces in the first and third pair have a slot and the other a tab and similarly one of the faces in the second and fourth pair having a slot and the other a tab, said faces, tabs and slots being disposed so that the opposing tabs and slots will interlock when the opposing faces are brought together.

3. A corner post having a first body portion and a second body portion, the two-body portions being connected to each other by and movable relative to each other about a slit-score line, an end member at each end of the first body portion and connected thereto by and movable relative to the first body portion about a slit-score line, a projecting tab on each end member, a plurality of slits disposed in the second body portion and disposed so that the tab on an end portion will enter on adjacent slit when the end members are pivoted about slit-score line, each slit and adjacent tab adapted detachably to provide means for holding the first and second body portions in fixed relationship to each other when a tab is in a slit.

* * * * *